US008361552B2

(12) United States Patent
Rotzoll

(10) Patent No.: US 8,361,552 B2
(45) Date of Patent: Jan. 29, 2013

(54) METHOD OF PRODUCING AN ADHERENT METALLIC COATING ON A STEEL SHEET PRODUCT

(75) Inventor: Sven-Lars Rotzoll, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 837 days.

(21) Appl. No.: 12/478,437

(22) Filed: Jun. 4, 2009

(65) Prior Publication Data

US 2009/0311428 A1 Dec. 17, 2009

(30) Foreign Application Priority Data

Jun. 12, 2008 (DE) ..... 10 2008 027 916

(51) Int. Cl.
*B05D 3/00* (2006.01)
*B23K 28/00* (2006.01)

(52) U.S. Cl. ..... 427/295; 427/294; 427/405; 228/193; 228/195

(58) Field of Classification Search ..... 427/327, 427/328, 295, 294, 405, 318, 225, 146, 152, 427/147, 148; 228/193, 195, 196, 197
See application file for complete search history.

(56) References Cited

U.S. PATENT DOCUMENTS

| | | | | |
|---|---|---|---|---|
| 2,247,890 | A * | 7/1941 | Reardon | 310/216.007 |
| 3,950,841 | A * | 4/1976 | Conn | 228/125 |
| 4,427,716 | A * | 1/1984 | Siwek | 148/535 |
| 5,147,086 | A * | 9/1992 | Fujikawa et al. | 228/235.1 |
| 5,298,095 | A | 3/1994 | Russo et al. | |
| 5,415,892 | A * | 5/1995 | Nishizawa | 427/295 |

FOREIGN PATENT DOCUMENTS

| | | | |
|---|---|---|---|
| DE | 42 42 773 | A1 | 6/1993 |
| DE | 102 24 319 | A1 | 12/2003 |
| DE | 697 32 466 | T2 | 6/2005 |
| DE | 602 18 946 | T2 | 11/2007 |
| EP | 1 013 785 | A1 | 6/2000 |

OTHER PUBLICATIONS

Atkinson et al. "Fundamental Aspects of Hot Isostatic Pressing: An Overview", Metallurgical and Materials Transactions A, vol. 31A, Dec. 2000, pp. 2981-3000.*

* cited by examiner

*Primary Examiner* — Dah-Wei Yuan
*Assistant Examiner* — Jose Hernandez-Diaz
(74) *Attorney, Agent, or Firm* — Henry M. Feiereisen LLC

(57) ABSTRACT

In a method of applying a firmly adhering metallic coating onto a steel sheet product, a steel sheet product is inserted into a film bag which contains at least a coating material. Subsequently, the film bag is evacuated to cause the film to evenly bear upon the outer surface of the steel sheet product. This state is fixed by sealing the film bag. The film bag and the steel sheet product are then subjected to a heat treatment to thereby form a coating of the coating material on the steel sheet product.

18 Claims, 3 Drawing Sheets

METHOD OF PRODUCING AN ADHERENT METALLIC COATING ON A STEEL SHEET PRODUCT

CROSS-REFERENCES TO RELATED APPLICATIONS

This application claims the priority of German Patent Application, Serial No. 10 2008 027 916.1, filed Jun. 12, 2008, pursuant to 35 U.S.C. 119(a)-(d), the content of which is incorporated herein by reference in its entirety as if fully set forth herein.

BACKGROUND OF THE INVENTION

The present invention relates to a method of producing an adherent metallic coating on a steel sheet product.

The following discussion of related art is provided to assist the reader in understanding the advantages of the invention, and is not to be construed as an admission that this related art is prior art to this invention.

Profiled structures made of steel sheet are coated to improve their properties, particularly for preventing corrosion or reducing wear. Various processes have been used to apply adherent layers of formless nature on metallic surfaces, such as sheets. Examples of such processes include hot galvanizing, electrogalvanizing, metal spraying of zinc, or sherardizing.

European patent document EP 1 013 785 A1 describes a method for coating a hot-rolled sheet steel with a metal or metal alloy, such as aluminum, by a dipping process. A blank is cut to size from the sheet steel and subjected to a temperature increase to initiate the forming process. As a result, an intermetallic phase is created on the surface for protection of the steel against corrosion and decarburation. After forming the sheet steel, the hot-formed steel sheet structure is cooled to confer hardness.

German patent document DE 102 24 319 A1 describes a method of making a coated structure for the automobile construction. A strip of hardenable steel or a blank from the strip is first coated with a metal or metal alloy in a process causing physical-mechanical bonding. The blank is then cold-formed and then hot-formed and hardened.

A problem associated with conventional methods is their limitation when hot formed steel sheet products are involved in order to produce a metallic surface coating. A reason resides in the necessary heating phase for the hot forming process. Pre-galvanizing, typically required for steel sheets, is not possible or only possible to a limited extent because zinc would be melted away during the heating phase. Although theoretically galvanizing may be carried out later, this however is time-consuming and complicates the overall construction and logistics. In addition, the result would be excessive layer thicknesses which render a welding of steel sheet products virtually impossible. While electrogalvanizing could conceivably provide thinner layer thicknesses, there is still the problem that high-strength steels cannot be coated as a result of hydrogen embrittlement which leads to premature crack formation.

It would therefore be desirable and advantageous to provide an improved method of producing an adherent metallic coating on a steel sheet product to obviate prior art shortcomings and to produce a coating, which can be realized with a defined layer thickness in a simple and economical manner and permits subsequent welding operations.

SUMMARY OF THE INVENTION

According to one aspect of the present invention, a method of producing an adherent metallic coating on a steel sheet product includes the steps of inserting a steel sheet product into a film bag which contains at least a coating material, evacuating and sealing the film bag, and subjecting the film bag and the steel sheet product to a heat treatment to thereby form a coating of the coating material on the steel sheet product.

According to another feature of the present invention, the film bag may be made entirely of the coating material. Suitably, the film bag may be produced from a carrier film which is provided with the coating material. The coating material can hereby be applied upon the carrier film at a defined layer thickness. As a result a laminate film is realized which constitutes the film material for making the film bag in which the steel sheet product is inserted. The film bag may also be produced when combined with the steel sheet product by positioning the steel sheet product between two layers of films, with the film layers then joined together along the edges of the steel sheet product to form the film bag.

According to another feature of the present invention, the film bag may also be preformed before the inserting step, e.g. by imposing a shape, to best suit the configuration of the film bag to the steel sheet product. Air is then drawn by a vacuum pump out of the film bag to enable the film bag to closely and evenly wrap the steel; sheet product.

After sealing the film bag, the coating is transferred onto the steel sheet product through heat treatment. The coating may, for example, be realized by a diffusion process between the steel sheet product and the coating material. It may also be conceivable to realize proper adhesion of the coating by a burning-in process. As a result of the heat treatment, the coating material bonds with the steel sheet product. The heat treatment may be implemented in a gas-heated or oil-heated continuous furnace. Also inductive or conductive heat treatment is possible. Furthermore, the steel sheet product may also be heated to the required process temperature under pressure in a water or steam bath.

The temperature range and the duration of heat treatment are dependent on the selected coating material. Currently preferred is, however, a temperature range during heat treatment between 300° C. and 450° C., in particular for the application of a zinc coating or a zinc aluminum coating. Suitably, the carrier film may be a plastic film which is resistant to high temperature. Depending on the required process temperature, it is also possible to employ a metallic carrier foil, e.g. an aluminum foil. The duration of heat treatment is dependent on the selected coating material and the configuration of the carrier film and may range from 0.15 h to 2.0 h.

Once the steel sheet product has been coated, residue of the film bag, in particular carrier film, can be removed. This may be implemented through abrasion by means of water jets. Of course, it is also conceivable to burn off the residue or to apply flame treatment or employ chemical stripping processes.

According to another feature of the present invention, the steel sheet product may be surface-treated before the steel sheet product is coated by the heat treatment. In this way, the steel sheet product is cleansed and becomes metallically smooth. This may be realized, for example, through etching, or in particular sand blasting when high-strength steel is involved.

The present invention relates in particular to producing a coating of zinc resolves prior art problems by inserting the metallically pure steel sheet product in the film bag which is made of coating material or at least contains coating material. After evacuation, the film bears evenly upon the outer surfaces of the steel sheet product to be coated. Sealing the film bag fixes this state. The steel sheet product enveloped by the film bag then undergoes a heat treatment to cause the formation of the coating on the steel sheet product, i.e. transfer of the coating onto the steel sheet product.

The present invention provides an efficient and simple method to produce an adherent metallic coating of high quality, in particular a zinc coating, on three-dimensional profiled structures of steel sheet. The coating is realized in dry state with optimal utilization of the coating material. Another benefit is the ability to form the produced coating on the steel sheet product. The coating is evenly dispersed across the entire surface and ductile. The layer thickness is defined so that attachments can be secured to the steel sheet product later on, employing normal welding operations. The thickness of the coating can range from 5 μm to 20 μm. The layer thickness depends hereby on the selected coating material. In the case of a zinc coating, the layer thickness ranges from 5 μm to 15 μm, if the steel sheet product should be welded thereafter. Although the afore-stated range of layer thicknesses is currently preferred, the present invention should not be limited to this range of layer thicknesses as thicker layer thicknesses are, of course, conceivable as well.

Currently preferred is the application of the present invention for galvanizing of hot formed profiled structures of steel sheet. As a result, coating material is used which has as main ingredient zinc or a zinc composition, with optional addition of additives to improve chemical and physical properties of the coating. The film bag may be made for example by coating the carrier film with a zinc powder. This coated carrier film forms the basis for manufacturing the film bag.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
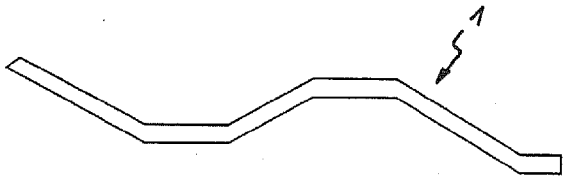
FIG. 1 is a schematic illustration of a structure to be coated.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 2:
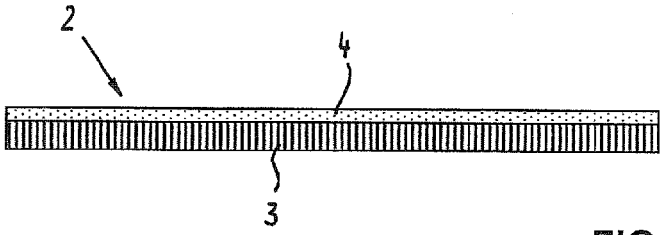
FIG. 2 is a schematic illustration of a portion of a coating film.

Turning now to the drawing, and in particular to FIG. 1, there is shown a schematic illustration of a steel sheet product 1 to be coated in the form of a hot-formed profiled structure of steel sheet. A coating film 2, shown in FIG. 2, is produced in accordance with the geometric dimensions and desired layer thickness of a coating. The film 2 is comprised of a carrier film 3 and a coating material 4 which is applied onto the carrier film 3 at a desired layer thickness. The coating material is made, for example, of zinc or a zinc composition, such as zinc aluminum and, optionally, additional components, so as to influence the chemical behavior, in particular as far as corrosion-resistance and physical characteristics such as adhesion of the produced coating, are concerned.

Figure 3:
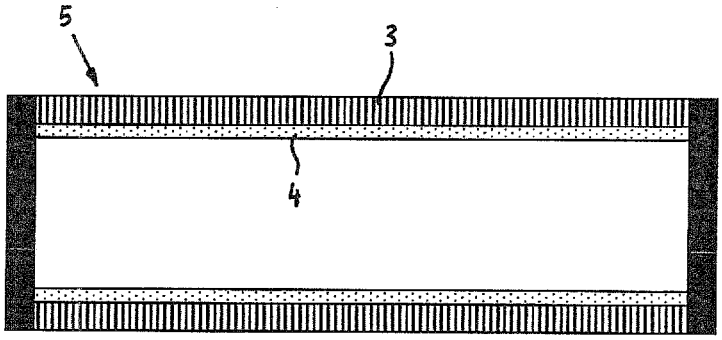
FIG. 3 is a schematic illustration of a film bag of coating film.

The film 2 forms the basis for producing a film bag 5, as shown in FIG. 3. The coating material 4 is arranged on the inside of the film bag 5 which is open on one side to allow insertion of the steel sheet product 1 to be coated.

Figure 4:
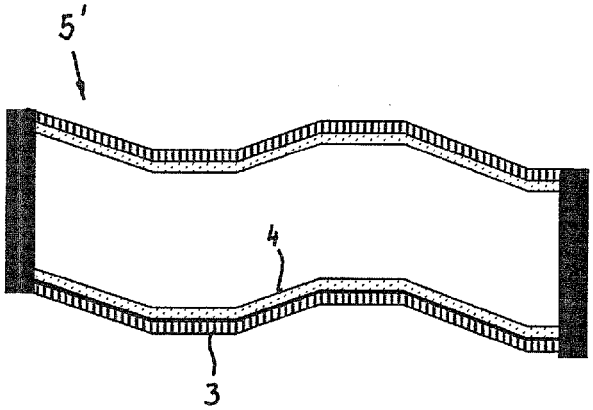
FIG. 4 is a schematic illustration of a preformed film bag of coating film.

The film bag 5 may, optionally, be preformed to better suit the shape of the steel sheet product 1 to be coated. FIG. 4 shows an example of such a preformed film bag 5'.

Figure 5:
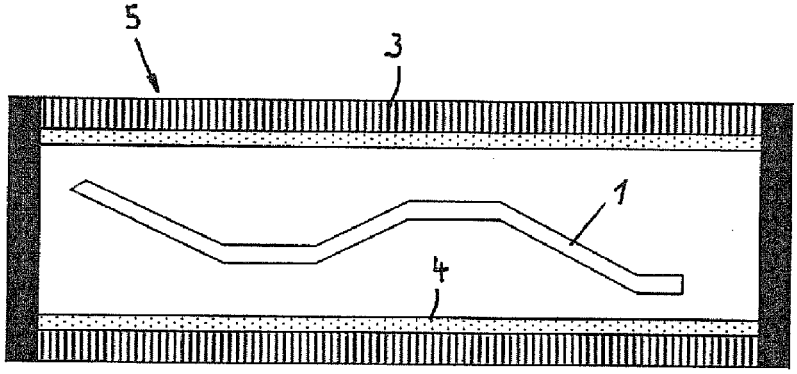
FIG. 5 is a schematic illustration of a steel sheet product placed in the film bag of FIG. 3.
Figure 6:
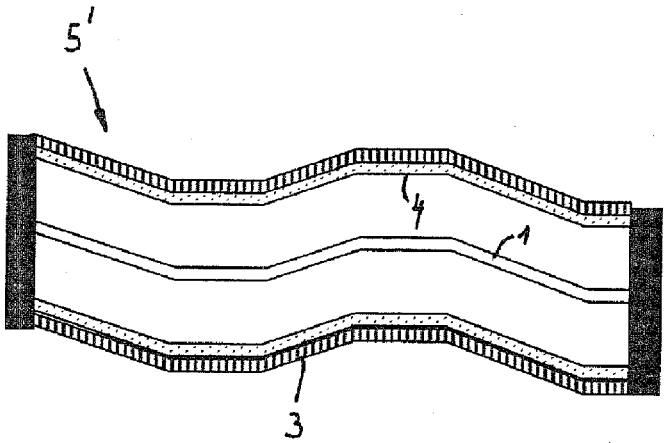
FIG. 6 is a schematic illustration of a steel sheet product placed in the film bag of FIG. 4.

The steel sheet product 1 to be coated is placed into the film bag 5, 5'. FIG. 5 shows hereby the placement of the steel sheet product 1 in a film bag 5 which has not been preformed, whereas FIG. 6 shows the insertion of a steel sheet product 1 in a preformed film bag 5'.

Figure 7:
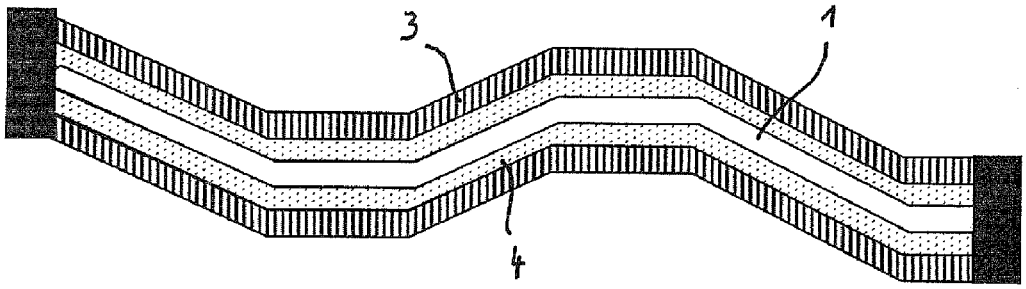
FIG. 7 is a schematic illustration of a steel sheet product closely wrapped by the film bag.
Figure 8:
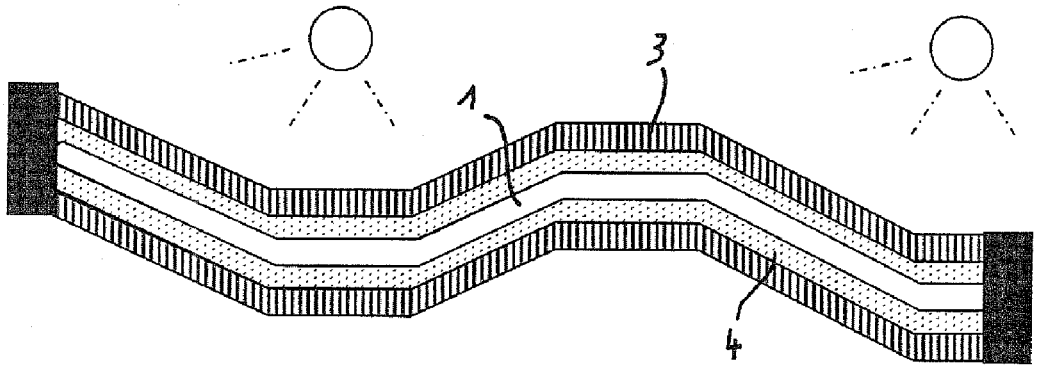
FIG. 8 is a schematic illustration of the steel sheet product within the film bag undergoing a heat treatment.

Subsequently, the film bag 5, 5' is evacuated by a vacuum pump (not shown) which removes air from inside the film bag 5, 5'. As the inside is evacuated, the film bag 5, 5' and its material bears evenly upon the outer surfaces of the steel sheet product 1. This state is fixed by sealing the film bag 5, 5' and shown in FIG. 7.

Figure 9:
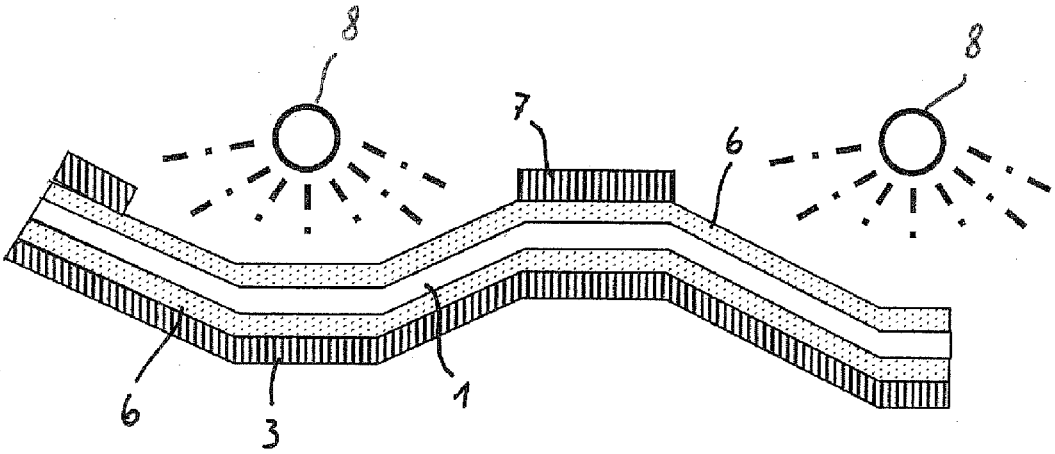
FIG. 9 is a schematic illustration of a coated steel sheet product undergoing a subsequent cleaning operation.

Next, as shown in FIG. 9, the film bag 5, 5' with contained steel sheet product 1 undergoes a heat treatment by which the coating material 4 is transferred onto the steel sheet product 1 to thereby form the coating 6. Currently preferred is the application of the heat treatment in a continuous process which may be implemented in various ways. Typically, radiation, convection, and conduction is used as heat treatment.

After heat treatment and formation of the coating 6, the carrier film 3 or left-over residues of the carrier film 3 are removed from the steel sheet product 1. This may be realized, as shown in FIG. 9, with the aid of a cleaning device 8 which may employ water jets or burning off or flame treatment in order to strip away the carrier film 3.

Figure 10:
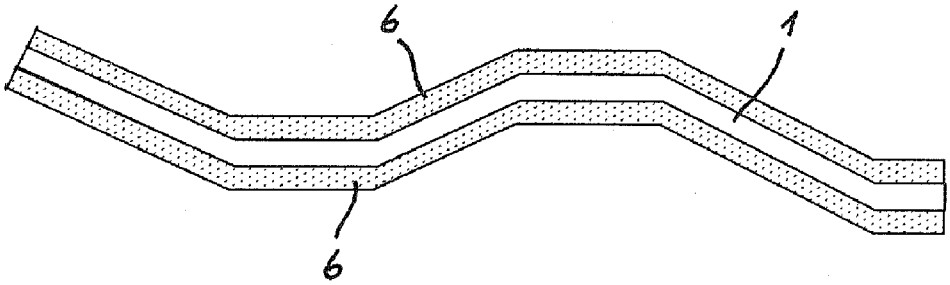
FIG. 10 is a schematic illustration of a coated steel sheet product.

The coated steel sheet product 1 is shown in FIG. 10. As can be seen therefrom, an even ductile coating 6, for example of zinc, is produced across the entire surface of the steel sheet product 1. The thickness of the coating 6 may range between 5 μm and 20 μm. The coating 6 is of high quality and can easily be shaped so that the steel sheet product 1 may, optionally, undergo further forming processes. The quality of the coating 6 also permits application of subsequent welding operations, e.g. to join of attachments with typical welding processes. Also thicker layer thicknesses are easy to realize.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed as new and desired to be protected by Letters Patent is set forth in the appended claims and includes equivalents of the elements recited therein:

1. A method of producing an adherent metallic coating on a steel sheet product, comprising the steps of:

inserting a steel sheet product into a film bag which contains at least a coating material;

evacuating and sealing the film bag; and subjecting the film bag and the steel sheet product to a heat treatment to thereby form a coating of the coating material on the steel sheet product, wherein the film bag is made of the coating material.

2. The method of claim 1, wherein the steel sheet product is hot-formed profiled structure.

3. The method of claim 1, further comprising the step of preforming the film bag before the inserting step.

4. The method of claim 1, further comprising the step of removing residue of the film bag after the subjecting step.

5. The method of claim 1, further comprising the step of surface-treating the steel sheet product before the subjecting step.

6. The method of claim 1, wherein the formation of the coating is realized by a diffusion process between the steel sheet product and the coating material.

7. The method of claim 1, wherein the heat treatment is executed at a temperature between 300° C. and 450° C.

8. The method of claim 1, wherein the heat treatment is executed over a time period of 0.15 h to 2.0 h.

9. A method of producing an adherent metallic coating on a steel sheet product, comprising the steps of:

inserting a steel sheet product into a film bag which contains at least a coating material;

evacuating and sealing the film bag:

subjecting the film bag and the steel sheet product to a heat treatment to thereby form a coating of the coating material on the steel sheet product; and producing the film bag from a carrier film which is provided with the coating material.

10. The method of claim 9, wherein the steel sheet product is hot-formed profiled structure.

11. The method of claim 9, wherein the coating material is applied upon the carrier film at a defined layer thickness.

12. The method of claim 11, wherein the layer thickness ranges from 5 μm to 20 μm.

13. The method of claim 9, further comprising the step of preforming the film bag before the inserting step.

14. The method of claim 9, further comprising the step of removing residue of the film bag after the subjecting step.

15. The method of claim 9, further comprising the step of surface-treating the steel sheet product before the subjecting step.

16. The method of claim 9, wherein the formation of the coating is realized by a diffusion process between the steel sheet product and the coating material.

17. The method of claim 9, wherein the heat treatment is executed at a temperature between 300 ° C. and 450 ° C.

18. The method of claim 9, wherein the heat treatment is executed over a time period of 0.15 h to 2.0 h.

* * * * *